US009689250B2

(12) United States Patent
Badkoubeh et al.

(10) Patent No.: US 9,689,250 B2
(45) Date of Patent: Jun. 27, 2017

(54) SYSTEM AND METHOD FOR MITIGATING STICK-SLIP

(71) Applicant: Tesco Corporation, Houston, TX (US)

(72) Inventors: Amir Badkoubeh, Calgary (CA); Alex Strand, Calgary (CA); Douglas Greening, Calgary (CA)

(73) Assignee: TESCO CORPORATION, Houston, TX (US)

( * ) Notice: Subject to any disclaimer, the term of this patent is extended or adjusted under 35 U.S.C. 154(b) by 248 days.

(21) Appl. No.: 14/543,675

(22) Filed: Nov. 17, 2014

(65) Prior Publication Data

US 2016/0138382 A1 May 19, 2016

(51) Int. Cl.

| | |
|---|---|
| ***E21B 44/04*** | (2006.01) |
| ***E21B 3/035*** | (2006.01) |
| ***E21B 44/00*** | (2006.01) |

(52) U.S. Cl.

CPC ..... *E21B 44/04* (2013.01); *E21B 3/035* (2013.01); *E21B 44/00* (2013.01)

(58) Field of Classification Search

CPC ..... E21B 44/04; E21B 44/00; E21B 3/035; G05D 19/02

See application file for complete search history.

(56) References Cited

U.S. PATENT DOCUMENTS

| | | | |
|---|---|---|---|
| 8,689,906 B2 | 4/2014 | Nessjoen et al. | |
| 2004/0118608 A1* | 6/2004 | Haci | E21B 7/068 175/26 |

(Continued)

FOREIGN PATENT DOCUMENTS

| | | |
|---|---|---|
| CN | 103939082 | 7/2014 |
| WO | 2014147118 | 9/2014 |

OTHER PUBLICATIONS

PCT/US2015/060191 International Search Report and Written Opinion dated Jan. 26, 2016.

(Continued)

*Primary Examiner* — Brad Harcourt

(74) *Attorney, Agent, or Firm* — Fletcher Yoder, P.C.

(57) ABSTRACT

The present disclosure is directed to systems and methods for rotating a drill string to mitigate stick-slip oscillations. An embodiment includes a method of rotating a drill string driven by a drive system using a control system. The method includes measuring torque values of the drive system with a torque sensor. The method also includes determining a frequency of stick-slip oscillations at the drive system based on the torque values using the control system. The method also includes determining an estimated instantaneous rotational speed of the drive system with the control system based on at least the frequency of stick-slip oscillations and a characteristic impedance of the drill string. The method also includes adjusting the estimated instantaneous rotational speed based on changes in the torque values to define an adjusted estimated instantaneous rotation speed with the control system. The method also includes providing an output signal representing the adjusted estimated instantaneous rotational speed to the drive system. The method also includes controlling rotation of a quill of the drive system based on the output signal.

13 Claims, 7 Drawing Sheets

(56) References Cited

U.S. PATENT DOCUMENTS

| | | | |
|---|---|---|---|
| 2011/0232966 | A1 | 9/2011 | Kyllingstad |
| 2014/0305702 | A1 | 10/2014 | Bowley et al. |

OTHER PUBLICATIONS

G. Halsey, et al., Torque Feedback Used to Cure Slip-Stick Motion, SPE 18049, 1988, pp. 277-282, Houston, Texas, 6 pgs.

J.Jansen, et al., Active Dampening of Self-Excited Torsional Vibrations in Oil Well Drillstrings, Journal of Sound and Vibration, 1995, pp. 647-668, vol. 179, No. 4, 22 pgs.

M. Johannessen, et al., Stick-Slip Prevention of Drill Strings Using Nonlinear Model Reduction and Nonlinear Model Predictive Control, Norwegian University of Science and Technology, May 2010, 109 pgs.

N. Challamel, et al., A Stick-slip Anaiysis Based on Rock/Bit Interaction: Theoretical and Experimental Contribution, IADC/SPE 59230 Drilling Conference, Feb. 2000, New Orleans, Louisiana, 10 pgs.

J.N. Shive, "Similarities in Wave Behavior," Bell Telephone Laboratories Inc., 1961, video, accessed Nov. 17, 2014 online via http://techchannel.att.com/play-video.cfm/2011/3/7/AT&T-Archives-Similarities-of-Wave-Behavior.

Johannessen, M, & Myrvold, T, Stick-Slip Prevention of Drilling Strings Using Nonlinear Model Reduction and Nonlinear Model Preditive Control, 2010, 111 pgs.

Canudas-de-Wit, C., Corchero, M., Rubio, F.R. & Navarro, E., D-OSKILL: a new Mechanism for Supression Stick-Slip in Oil Well Drillstrings, 2005, 6 pgs.

Cobern, M., & Wessell, M., Laboratory Testing of an Active Drilling Vibration Monitoring & Control System, AADE paper, Houston, Texas, 2005, 14 pgs.

* cited by examiner

SYSTEM AND METHOD FOR MITIGATING STICK-SLIP

BACKGROUND

Embodiments of the present disclosure relate generally to the field of drilling and processing of wells. More particularly, present embodiments relate to a system and method for addressing stick-slip issues during certain drilling operations.

In conventional oil and gas operations, a well is typically drilled to a desired depth with a drill string, which may include drill pipe and a drill bit. The drill pipe may include multiple sections of tubular that are coupled to one another by threaded connections or tool joints. During a drilling process, the drill string may be supported and hoisted about a drilling rig and be lowered into a well. A drive system (e.g., a top drive) at the surface may rotate the drill string to facilitate drilling a borehole. Because the drill string is a slender structure relative to the length of the borehole, the drill string is subject to various vibrations or oscillations due to the interaction with the borehole wall.

Stick-slip may be generally defined as the torsional vibration of downhole components or equipment (e.g., drill pipe, drill bit), as it slides against the edges of the borehole. Stick-slip oscillations are severe, self-sustained and periodic torque fluctuations of the drill string torque. The oscillations are driven by nonlinear downhole friction and characterized by large bit speed variations, sometimes up to three times of its nominal value. The reflection of these downhole oscillations can be sensed on the surface through fluctuation of the surface torque, when the surface drive system (e.g., the top drive) is running in a speed control mode. Running with a constant speed, the surface drive system may act as an effective reflector. As a result, vibrational energy is going back and forth along the drill string, and severe torsional oscillations may build up. Stick-slip oscillations are recognized as being a major source of problems such as fatigue failures, excessive bit wear, and poor drilling rate.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
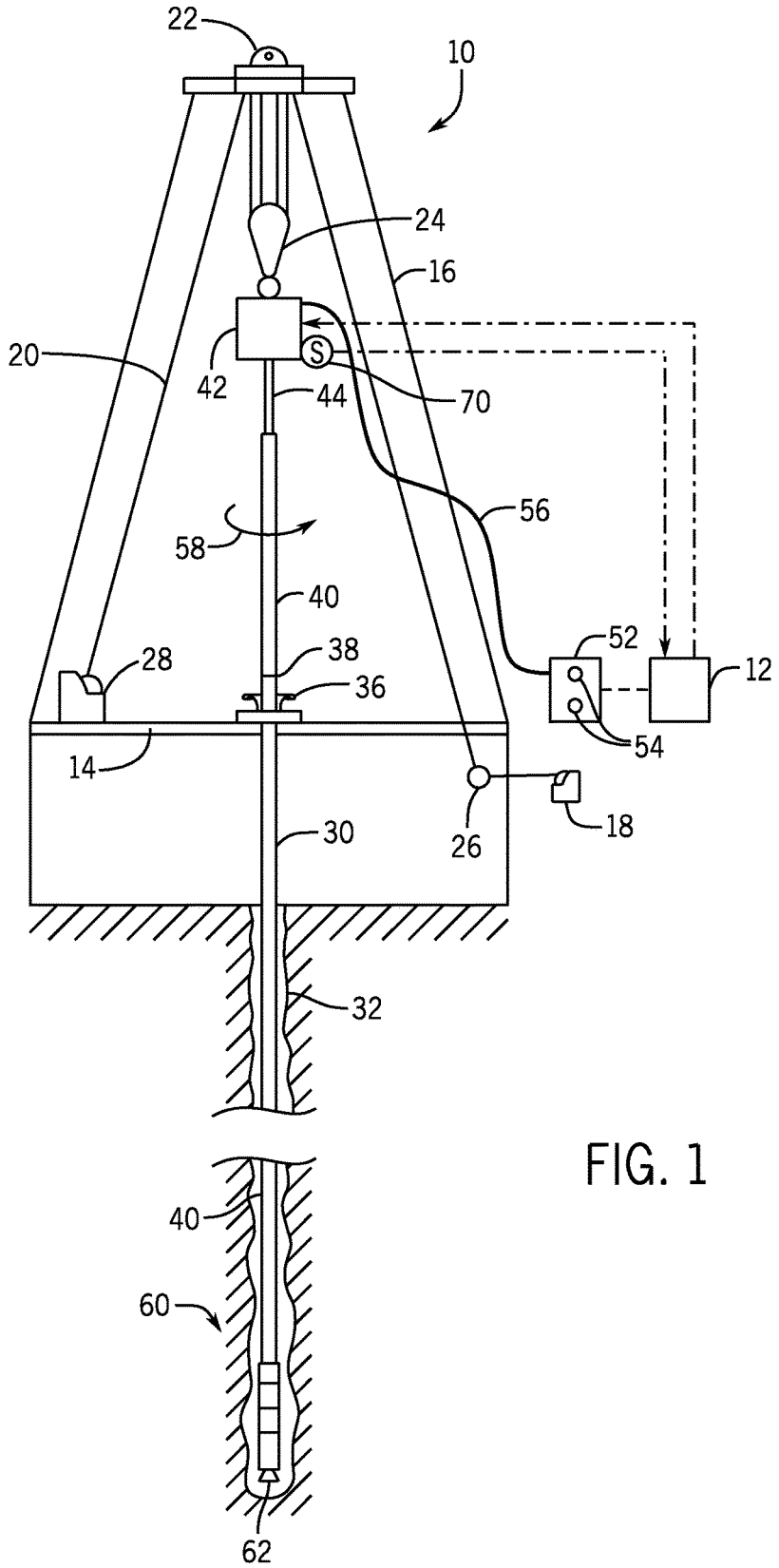
FIG. 1 is a schematic of a drilling rig including a drilling control system in accordance with present techniques.

As noted above, frictional engagement of the drill string with the borehole may cause the drill string to stick and slip.

For example, due to the interaction with the rock, the drill bit may slow down and finally stall while the top drive is still in motion. This may cause the drill bit to be suddenly released after a certain time and to start rotating at a very high speed before being slowed down again. The velocity oscillations of the drill bit may give rise to the emission of torsional waves from the lower end of the drill string. The wave may travel up along the drill string and may reflect from the top drive.

One technique to mitigate or reduce stick-slip oscillations is injecting back the inverse of the wave as an adjustment to the desired torque input of the drive system. This may be implemented through a torque feedback scheme. For example, a torque may be measured from either a dedicated string torque sensor, the top drive current, or the drive directly, in the drive system. Based on the measured torque and other parameters (e.g., the spring mass and damper model of the drill string), a torque controller may be derived to inject a new wave to the drive system to dampen the waves travelling up from the drill string.

Another technique to mitigate or reduce stick-slip oscillations is matching the impedance of the two media (e.g., the drive system and the drill string) to dampen the reflected wave from one media to the other. The speed control loop for the drive system may be adjusted based on an estimation of the downhole speed.

Provided herein are techniques for mitigating or reducing stick-slip oscillations in a drilling system using a combination of torque feedback and impedance matching on feed forward speed controller of the drive system. In one embodiment, a technique for mitigating stick-slip oscillations includes a speed controller (e.g., a cascade feedback and proportional-integral (PI) controller) to control the speed of rotation of the drive system (e.g., a top drive) to mitigate or reduce the detected stick-slip oscillation. A sensor (e.g., a torque sensor) may be coupled to the top drive system to detect the surface torque in real time. The severity of stick-slip of the drilling system may be monitored or detected based on a defined criterion, such as a stick-slip index or threshold. The speed controller may adjust a reference speed of rotation of the drive system based on to the measured torque feedback from the sensor. In certain embodiments, a first order filter may be implemented on the measured torque feedback signal to filter out zero frequency components (e.g., DC components) and high frequency components of the torque signal. The speed controller may then calculate proper gains (e.g., proportional and integral gains) based on impedance matching and the adjusted reference speed to adjust the speed of rotation of the drive system to reduce or mitigate the stick-slip oscillations. While downhole data could be utilized in accordance with present embodiments, it should be noted that a controller in accordance with certain embodiments of the present disclosure does not use downhole data. Indeed, in certain onshore and offshore rigs, such downhole data is unavailable. Accordingly, a benefit of present embodiments includes operation based on surface signals alone to estimate downhole behavior.

As the techniques disclosed herein are based on a combination of the torque feedback techniques and the impedance matching techniques, the present techniques may provide an enhanced tradeoff between the dampening of the reflected wave and the rate of penetration (ROP) in the drilling. Hence, the speed controller disclosed herein may result in a balanced drive system such that the drive system is soft enough to allow cascading the torque feedback and to provide good dampening, while the drive system is not too soft to impair the drilling rate of penetration (ROP). As used herein, "soft" (or "softness") and "stiff" (or "stiffness") are used to describe a drive system (e.g., a top drive) relative to a load (e.g., the drill string) regarding the torsional wave traveling along the load. A softer drive system may be referred to the drive system that has a smaller reflection and a greater dampening of the torsional wave. A stiffer drive system may be referred to the drive system that has a greater reflection and a smaller dampening of the torsional wave.

With the foregoing in mind, FIG. 1 illustrates a schematic of a drilling rig 10 including a drilling control system 12 in accordance with the present disclosure. The drilling rig 10 features an elevated rig floor 14 and a derrick 16 extending above the rig floor 14. A supply reel 18 supplies drilling line 20 to a crown block 22 and traveling block 24 configured to hoist various types of drilling equipment above the rig floor 14. The drilling line 20 is secured to a deadline tiedown anchor 26, and a drawworks 28 regulates the amount of drilling line 20 in use and, consequently, the height of the traveling block 24 at a given moment. Below the rig floor 14, a drill string 30 extends downward into a wellbore 32 and is held stationary with respect to the rig floor 14 by slips 36. The drill string 30 may include multiple sections of threaded tubular 40 that are threadably coupled together. It should be noted that present embodiments may be utilized with drill pipe, casing, or other types of tubular.

A portion of the drill string 30 extends above the rig floor 14 and is coupled to a top drive 42. The top drive 42, hoisted by the traveling block 24, may engage and position the drill string 30 (e.g., a section of the tubular 40) above the wellbore 32. Specifically, the top drive 42 includes a quill 44 used to turn the tubular 40 and, consequently, the drill string 30 for drilling operations. After setting or landing the drill string 30 in place such that the male threads of one section (e.g., one or more joints) of the tubular 40 and the female threads of another section of the tubular 40 are engaged, the two sections of the tubular 40 may be joined by rotating one section relative to the other section (e.g., in a clockwise direction) such that the threaded portions tighten together. Thus, the two sections of tubular 40 may be threadably joined. During other phases of operation of the drilling rig 10, the top drive 42 may be utilized to disconnect and remove sections of the tubular 40 from the drill string 30. As the drill string 30 is removed from the wellbore 32, the sections of the tubular 40 may be detached by disengaging the corresponding male and female threads of the respective sections of the tubular 40 via rotation of one section relative to the other in a direction opposite that used for coupling.

The drilling rig 10 functions to drill the wellbore 32. Indeed, the drilling rig 10 includes the drilling control system 12 in accordance with the present disclosure. The drilling control system 12 may coordinate with certain aspects of the drilling rig 10 to perform certain drilling techniques. For example, the drilling control system 12 may control and coordinate rotation of the drill string 30 via the top drive 42 and supply of drilling mud to the wellbore 32 via a pumping system 52. The pumping system 52 includes a pump or pumps 54 and conduit or tubing 56. The pumps 54 are configured to pump drilling fluid downhole via the tubing 56, which communicatively couples the pumps 52 to the wellbore 32. In the illustrated embodiment, the pumps 54 and tubing 56 are configured to deliver drilling mud to the wellbore 32 via the top drive 42. Specifically, the pumps 54 deliver the drilling mud to the top drive 42 via the tubing 56, the top drive 42 delivers the drilling mud into the drill string 30 via a passage through the quill 44, and the drill string 30 delivers the drilling mud to the wellbore 32 when properly engaged in the wellbore 32. The drilling control system 12 manipulates aspects of this process to facilitate performance of specific drilling strategies in accordance with present embodiments. For example, as will be discussed below, the drilling control system 12 may control rotation of the drill string 30 and supply of the drilling mud by controlling operational characteristics of the top drive 42 and pumping system 52 based on inputs received from sensors and manual inputs.

In the illustrated embodiment, the top drive 42 is being utilized to transfer rotary motion to the drill string 30 via the quill 44, as indicated by arrow 58. In other embodiments, different drive systems (e.g., a rotary table, coiled tubing system, downhole motor) may be utilized to rotate the drill string 30 (or vibrate the drill string 30). Where appropriate, such drive systems may be used in place of the top drive 42. It should be noted that the illustration of FIG. 1 is intentionally simplified to focus on particular features of the drilling rig 10. Many other components and tools may be employed during the various periods of formation and preparation of the well. Similarly, as will be appreciated by those skilled in the art, the orientation and environment of the well may vary widely depending upon the location and situation of the formations of interest. For example, the well, in practice, may include one or more deviations, including angled and horizontal runs. Similarly, while shown as a surface (land-based) operation, the well may be formed in water of various depths, in which case the topside equipment may include an anchored or floating platform.

In the illustrated embodiment, the drill string includes a bottom-hole assembly (BHA) 60 coupled to the bottom of the drill string 30. The BHA 60 includes a drill bit 62 that is configured for drilling the downhole end of the wellbore 32. Straight line drilling may be achieved by rotating the drill string 30 during drilling. In another embodiment, the drill bit 62 may include a bent axis motor-bit assembly or the like that is configured to guide the drill string 30 in a particular direction for directional drilling. The BHA 60 may include one or more downhole tools (e.g., a measurement-while-drilling (MWD) tool, a logging-while-drilling (LWD) tool) configured to provide data (e.g., via pressure pulse encoding through drilling fluid, acoustic encoding through drill pipe, electromagnetic transmissions) to the drilling control system 12 to facilitate drilling, including determining whether to rotate the drill string 26 via the top drive 42 and/or pump drilling mud via the pumping system 52. For example, the MWD tool and the LWD tool may obtain data including orientation of the drill bit 62, location of the BHA 60 within the wellbore 32, pressure and temperature within the wellbore 32, rotational information, mud pressure, tool face orientation, vibrations, torque, linear speed, rotational speed, and the like.

As will be discussed below, the top drive 42 and, consequently, the drill string 30 may be rotated based on instructions from the drilling control system 12, which may include automation and control features and algorithms for addressing static friction issues, such as stick-slip, based on measurement data and equipment. As illustrated, a sensor 70 may be coupled to the top drive 42 and configured to measure one or more parameters (e.g., torque, rotary speed, motor current) of the top drive 42 and to communicate the measured data to the drilling control system 12. Based on the measured data from the sensor 70 and/or the downhole tools (e.g., the MWD tool 64, the LWD tool 66), the drilling control system 12 may obtain the torque of the drill string 30, such as the torque of the drill bit 62. As will be discussed in greater detail below, the drilling control system 12 may control the rotation of the top drive 42 based on the measured torque of the drill string 30, as well as other parameters including the detected frequency of the stick-slip oscillations, to mitigate or reduce the stick-slip oscillations along the drill string 30. To control the rotation of the top drive 42, the drilling control system 12 may also use other variables including pipe size, size of hole, tortuosity, type of bit, rotations per minute, mud flow, inclination, length of drill string, horizontal component of drill string, vertical component of drill string, mass of drill string, manual input, weight on the bit (WOB), azimuth, tool face positioning, downhole temperature, downhole pressure, or the like. The drilling control system 12 may include one or more automation controllers with one or more processors and memories that cooperate to store received data and implement programmed functionality based on the data and algorithms. The drilling control system 12 may communicate (e.g., via wireless communications, via dedicated wiring, or other communication systems) with various features of the drilling rig 10, including, but not limited to, the top drive 42, the pumping system 52, the drawworks 26, and downhole features (e.g., the BHA 60). In some embodiments, the communication delay (e.g., between the sensor 70 and the drilling control system 12, and between the drilling control system 12 and the top drive 42) may be less than 50 milliseconds, such as less than 45 milliseconds, 40 milliseconds, 35 milliseconds, 30 milliseconds, 25 milliseconds, 20 milliseconds, 15 milliseconds, 10 milliseconds, or 5 milliseconds.

Figure 2:
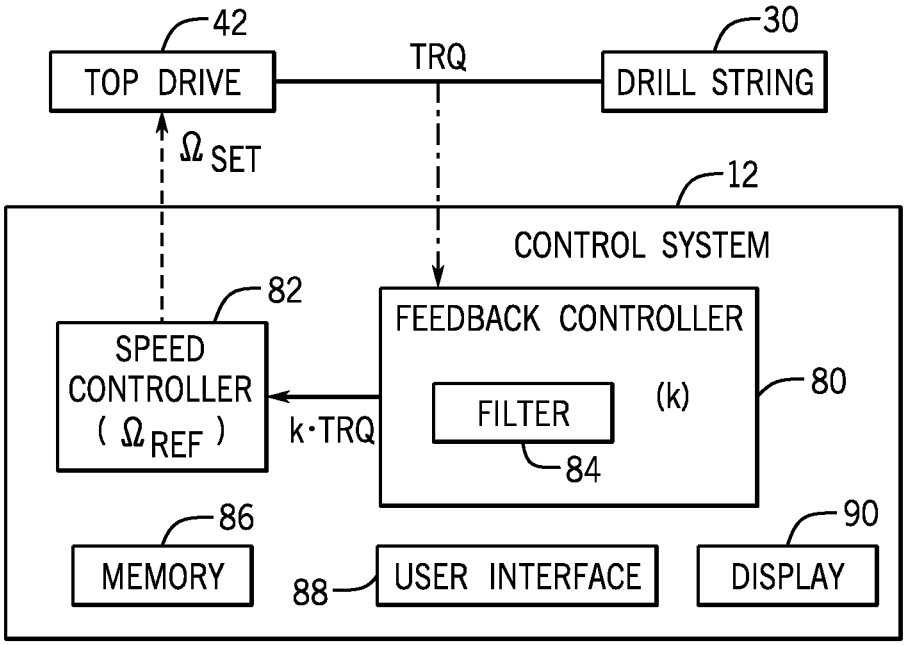
FIG. 2 is a schematic of a drilling control system of FIG. 1 in accordance with present techniques.

FIG. 2 illustrates schematically the drilling control system 12 in accordance with the present disclosure. As discussed above, the drilling control system 12 may control the rotation of the top drive 42 to rotate the drill string 30 for drilling the wellbore 32. The drilling control system 12 may include a distributed control system (DCS), a programmable logic controller (PLC), or any computer-based automation controller or set of automation controllers that is fully or partially automated. For example, the drilling control system 12 may be any device employing a general purpose or an application-specific processor. In the illustrated embodiment, the drilling control system 12 is separate from the top drive 42. It should be noted that, in some embodiments, aspects of the drilling control system 12 may be integrated with the top drive 42 or other features (e.g., the BHA 60).

The drilling control system 12 includes a feedback controller 80 and a speed controller 82 for controlling the rotation of the top drive 42 to mitigate or reduce the stick-slip oscillations of the drill string 30. The feedback controller 80 uses fluctuations in external torque, TRQ, of the drill string 30 as input variable. As noted above, the external torque, TRQ, of the drill string 30 may be measured by the sensor 70 coupled to the top drive 42 or by one or more downhole tools in the BHA 60. The feedback controller 80 may include a filter 84 (e.g., a band-pass filter) configured to filter out zero frequency components (e.g., DC components) and high frequency components of the measured torque signal, TRQ. As will be discussed in greater detail below, the feedback controller 80 includes a feedback gain, k, and a cut-off frequency, $\omega_0$, and may provide a product of the feedback gain, k, and the measured torque, TRQ, (or the filtered torque from the filter 84) to the speed controller 82.

The speed controller 82 includes a PI controller (or a proportional-integral-derivative (PID) controller) that includes a reference rotary speed, $\Omega_{ref}$, for the top drive 42. The reference rotary speed, $\Omega_{ref}$, for the top drive 42 is adjusted by the speed controller 82 in response to the measured torque feedback, TRQ, to set a rotary speed of the top drive 42, $\Omega_{set}$. For example, the speed controller 82 may set the rotary speed of the top drive 42, $\Omega_{set}$, by adjusting the reference rotary speed, $\Omega_{ref}$, in response to the product of the feedback gain, k, and the measured torque, TRQ, provided by the feedback controller 80. As discussed in greater detail below, the feedback controller 80 and the speed controller 82 may include certain functions and parameters, such as the feedback gain, k, a proportional gain, $K_P$, and an integral gain, $K_I$, to mitigate or reduce the stick-slip oscillations of the drill string 30.

The drilling control system 12 may include a memory 86 for storing instructions executable by the feedback controller 80 and the speed controller 82 to perform methods and control actions described herein for the top drive 42. The memory 86 may include one or more tangible, non-transitory, machine-readable media. By way of example, such machine-readable media can include RAM, ROM, EPROM, EEPROM, CD-ROM, or other optical disk storage, magnetic disk storage or other magnetic storage devices, or any other medium which can be used to carry or store desired program code in the form of machine-executable instructions or data structures and which can be accessed by a processor or by any general purpose or special purpose computer or other machine with a processor.

The drilling control system 12 may also include other components, such as a user interface 88 and a display 90. Via the user interface 88, an operator may provide commands and operational parameters to the drilling control system 12 to control various aspects of the operation of the drilling rig 10. The user interface 88 may include a mouse, a keyboard, a touch screen, a writing pad, or any other suitable input and/or output devices. The commands may include start and stop of the top drive 42, detection and calculation the frequency of the stick-slip oscillations of the drill string 30, engagement and disengagement of stick-slip oscillations mitigation function (e.g., provided by the feedback controller 80 and the speed controller 82), and so forth. The operational parameters may include temperature and pressure of the BHA 60, the number of drill pipes in the drill string 30, the length, inner diameter, and outer diameter of each drill pipe, and so forth. The display 90 may be configured to display any suitable information of the drilling rig 10, such as the various operational parameters of the drilling rig 10, the torque data of the drill string 30, the rotary speed of the top drive 42, and so forth.

As noted above, stick-slip oscillations occur due to a variation in downhole friction on the drill string 30 (e.g., the drill bit 62), which causes fluctuations of the torque of the drill string 30 and generates a torsional wave that is propagated upwards along the drill string 30 to the surface. When the torsional wave reaches the top drive 42, the torsional wave is partially reflected back into the drill string 30. For example, a top drive with a very stiff speed controller reflects nearly all of the torsional wave back to the drill string 30 and amplifies the oscillations in the whole system. An AC top drive may have a relatively stiff speed controller, compared to a hydraulic top drive, in order to keep the shaft speed constant. As such, the AC top drive may act as an effective reflector for torsional waves generated by changes of the downhole friction. On the other hand, if a top drive is very soft such that it dampens almost all of the torsional vibrations, it may result in a poor rate of penetration (ROP) for the drill string (e.g. the drill bit) and, consequently, reduced drilling performance. Hence, a good remedy to stick-slip may be characterized by providing a good dampening ratio while keeping the rate of penetration (ROP) high.

To quantify the top drive induced dampening of the torsional waves due to stick-slip oscillations, a parameter called reflection coefficient may be used. In classical Physics, the reflection coefficient is used to measure how much of a wave is reflected and how much is dampened at an interface. For example, the reflection coefficient of a load is determined by characteristic impedance of the load and characteristic impedance of the source of the wave. As such, in the context of top drive induced dampening of the stick-slip oscillations, a reflection coefficient, D, of the drill string 30 is determined by characteristic impedance, H, of the drill string 30 and characteristic impedance, Z, of the top drive 42. More specifically, the reflection coefficient, D, for torsional waves at the interface of drill string 30 and the top drive 42 may be defined as follows:

$$D = \frac{H - Z}{H + Z} \tag{1}$$

where H is the characteristic impedance of the drill string 30, and Z is the characteristic impedance of the top drive 42. A reflection coefficient magnitude less than one represents an energy loss or a dissipative system that will cause a dampening of torsional waves.

The characteristic impedance, H, of the drill string 30 is:

$$H = \frac{GI_p}{c} \tag{2}$$

where G (in $N \cdot m^{-2}$) is the shear modulus of the drill string 30, $I_p$ (in $m^4$) is the cross-sectional polar moment of inertia of the drill string 30, and c (in $m \cdot s^{-1}$) is the speed of torsional waves. The cross-sectional polar moment of inertia, $I_p$, of the drill string 30 is:

$$I_p = \frac{\pi}{64}(OD^4 - ID^4) \tag{3}$$

where OD (in m) and ID (in m) are outer diameter and inner diameter of the drill string 30, respectively. In embodiments where the drill string 30 includes n sections of drill pipes, OD and ID of the drill string 30 may be expressed as follows:

$$OD = \frac{\sum_{1=1}^{n} OD_i \times L_i}{\sum_{1=1}^{n} L_i} \tag{4}$$

and $$ID = \frac{\sum_{1=1}^{n} ID_i \times L_i}{\sum_{1=1}^{n} L_i} \tag{5}$$

where n is the number of drill pipe sections in the drill string 30, $OD_i$ (in m) and $ID_i$ (in m) are the outer diameter and inner diameter of each drill pipe section, respectively, and $L_i$ (in m) is the length of each drill pipe section.

Calculating the impedance, Z, of the top drive 42 may start from the equation of motion of the top drive output shaft:

$$J_{TD}\frac{d\Omega}{dt} = TRQ_d - TRQ \tag{6}$$

where TRQ (in N·m) is the external torque from the drill string 30, $TRQ_d$ (in N·m) is the mechanical torque of the top drive 42, Ω (in $rad \cdot s^{-1}$) is the actual output speed of the top drive 42, and $J_{TD}$ (in $kg \cdot m^2$) is the effective mass moment of inertia of the top drive 42. The effective mass moment of inertia, $J_{TD}$, of the top drive 42 may be calculated as follows:

$$J_{TD}=J_{GB}+n_{GB}^2 J_{rotor} \tag{7}$$

where $J_{GB}$ (in $kg \cdot m^2$) is the gearbox inertia, $n_{GB}$ is the gear ratio, and $J_{rotor}$ (in $kg \cdot m^2$) is the rotor inertia of the AC motor of the top drive 42. In some embodiments, the gearbox inertia, $J_{GB}$, the gear ratio, $n_{GB}$, and the rotor inertia, $J_{rotor}$, of the AC motor of the top drive 42 may be directly obtained from the manufacturer datasheet, and accordingly, the effective mass moment of inertia, $J_{TD}$, of the top drive 42 may be calculated according to Equation (7). In other embodiments, the effective mass moment of inertia, $J_{TD}$, of the top drive 42 may be obtained via a running test for the top drive 42 as described in greater detail below.

Neglecting the anti-wind up of the speed controller 82 for the top drive 42, the mechanical torque, $TRQ_d$, of the top drive 42 may be derived as follow:

$$TRQ_d=K_P(\Omega_{set}-\Omega)+K_I\int(\Omega_{set}-\Omega)dt \tag{8}$$

where $K_P$ and $K_I$ represent, respectively, the proportional gain and the integral gain of the speed controller 82 (e.g., a PI controller), and Ω and $\Omega_{set}$ are the actual and set point speed of the top drive 42, respectively.

By substituting Equation (8) into Equation (6) and reformulating Equation (6) in frequency domain (e.g., by applying Fourier transform), Equation (6) becomes:

$$\left(i\omega J_{TD} + K_P + \frac{K_I}{i\omega}\right)\Omega = \left(K_P + \frac{K_I}{i\omega}\right)\Omega_{set} - TRQ \tag{9}$$

where $i=\sqrt{-1}$ is the imaginary unit, and ω is the angular frequency of the top drive 42. For simplicity of the notation, the same variable names are used in both time and frequency domain representation of the system (e.g., the top drive 42, the drill string 30, and the drilling control system 12).

As noted above, the drilling control system 12 in the present disclosure includes the feedback controller 80 for applying corrections to the speed of the top drive 42 based on the feedback of the measured torque of the drill string 30. The feedback correction may be assumed to be proportional to the measured torque:

$$\Omega_{set}=\Omega_{ref}-k\times TRQ \tag{10}$$

where $\Omega_{ref}$ is the mean value of the demanded drilling speed and is a constant, and k is the feedback gain applied to the measured torque, TRQ.

In order that the actual speed differs only negligibly from the demanded speed, the DC component, or zero frequency component, of the torque signal, TRQ, may be excluded from the feedback process. For example, the filter 84 of the feedback controller 80 may be an AC-decoupling filter with the following filter function:

$$k = k_0 \frac{i\omega}{\omega_0 + ia\omega} \tag{11}$$

where $k_0$ is the torque feedback constant, $\omega_0$ is the cut-off frequency of the filter 84, and a is the adjustment coefficient.

Substituting Equation (10) and Equation (11) into Equation (9) and assuming the amplitude of the constant component of the demanded drilling speed, $\Omega_{ref}$, vanishes, Equation (9) becomes:

$$\left(i\omega J_{TD} + K_P + \frac{K_I}{i\omega}\right)\Omega = -\left(\frac{K_I + i\omega K_P}{i\omega}\right)\left(k_0 \frac{i\omega}{\omega_0 + ia\omega}\right)TRQ - TRQ \tag{12}$$

When selecting $\omega_0$ and a as follows:

$$\omega_0 = k_0 k_I \tag{13}$$

and $$a = k_0 k_p \tag{14}$$

Equation (12), representing the relationship between the actual speed, Ω, of the top drive 42 and the external torque, TRQ, of the drill string 30, becomes:

$$TRQ = -\frac{1}{2}\left(i\omega J_{TD} + K_P + \frac{K_I}{i\omega}\right)\Omega \tag{15}$$

Because the impedance, Z, of the top drive 42 is represented by the negative ratio of the external torque, TRQ, and the actual speed, Ω: −TRQ/Ω called the top drive impedance, Z:

$$Z = -\frac{TRQ}{\Omega} \tag{16}$$

Therefore, by combining Equation (15) and Equation (16), the impedance, Z, of the top drive 42 becomes:

$$Z = \frac{1}{2}\left(i\omega J_{TD} + K_P + \frac{K_I}{i\omega}\right) \tag{17}$$

In the embodiments where the speed controller 82 is a PID controller, a new term $i\omega K_D$ may be added to the bracket on the right side of Equation (17), where $K_D$ is the derivative gain of the speed controller 82. Because the term $i\omega K_D$ may be combined with the term $i\omega J_{TD}$, adding the derivative gain, $K_D$, in the case of PID controller is effectively adjusting the effective mass moment of inertia, $J_{TD}$, of the top drive 42 as in the case of PI controller. Accordingly, the discussion herein on the PI controller may be similarly applied to the PID controller. As the derivative gain, $K_D$, may make the speed controller 82 highly sensitive to measurement noise, in the embodiments where the speed controller 82 is a PID controller, the derivative gain, $K_D$, may be set to zero D.

Substituting the impedance, Z, of the top drive 42, as represented by Equation (17) into Equation (1), the reflection coefficient, D, for torsional waves at the interface of drill string 30 and the top drive 42 becomes:

$$D = \frac{2H - K_P - i(\omega J_{TD} - K_I/\omega)}{2H + K_P + i(\omega J_{TD} - K_I/\omega)} \tag{18}$$

When the imaginary part vanishes, this expression of D reaches its minimum value in magnitude:

$$D_{min} = \frac{|2H - K_P|}{2H + K_P} \tag{19}$$

The imaginary part of Equation (18) vanishes when the angular frequency, ω, of the top drive 42 becomes:

$$\omega = \sqrt{K_I/J_{TD}} \tag{20}$$

Therefore, from Equations (19) and (20), the integral gain, $K_I$ (in N·m), may be adjusted so that the maximum energy absorption of the torsional waves (i.e., the minimum (in magnitude) of the refection coefficient, D) at the interface of drill string 30 and the top drive 42 occurs at or near the stick-slip frequency:

$$K_I = \omega_s^2 J_{TD} \tag{21}$$

where $\omega_s$ (in rad·s$^{-1}$) is the stick-slip frequency, which may be expressed as:

$$\omega_s = \frac{2\pi}{T_s} \tag{22}$$

where $T_s$ (in s) is the period of stick-slip oscillation. As discussed in greater detail below, the period, $T_s$, of the stick-slip oscillation may be detected automatically from the stick-slip oscillation data.

To have the system dissipative with respect to the torsional waves, the magnitude of $D_{min}$ must be less than one. To this end, the proportional gain, $K_P$ (in N·m·s), may be determined as:

$$K_P = \frac{2H}{\mu} \tag{23}$$

where μ is a normalized mobility factor, dimensionless, and less than unity. Combining Equation (23) and Equation (2), the proportional gain, $K_P$, may be expressed as:

$$K_P = 2\frac{GI_p}{c\mu} \tag{24}$$

The proportional gain, $K_P$, as determined in Equations (23) and (24) refers to the output shaft side of the top drive 42. When the speed controller 82 refers to the motor axis side of the top drive 42, the proportional gain, $K_P$, for the motor speed control may be lower than that of the shaft side by a factor of $1/n_{GB}^2$.

Furthermore, in some embodiments, the top drive 42 (e.g., a motor of the top drive 42) uses per unit parameters. The per unit value of the proportional gain, $K_{P\text{-}PU}$ (in pu), may be calculated from the proportional gain, $K_P$ (in N·m·s), as derived in Equations (23) and (24). In these embodiments, the top drive 42 uses the motor nominal torque, $TRQ_{nm}$, which may be calculated as follows:

$$TRQ_{nm} = \frac{P_{nm}}{n_{nm} \times 2\pi/60} \tag{25}$$

where $n_{nm}$ (in RPM) is the motor nominal speed of the top drive 42, and $P_{nm}$ (in W) is the motor nominal power of the top drive 42. The per unit value of the proportional gain, $K_{P\text{-}PU}$, may be obtained based on $K_P$ as follows:

$$K_{P-PU} = \frac{K_P n_{sync} \times 2\pi f_{nm}}{TRQ_{nm}} \tag{26}$$

where $n_{sync}$ is the synchronous speed of the motor, and $f_{nm}$ is the motor nominal frequency. The synchronous speed, $n_{sync}$, of the motor in turn may be expressed as:

$$n_{sync}=120\times f_{nm}/p \tag{27}$$

where p is the number of poles of the motor. Therefore, the per unit value of the proportional gain, $K_{P\text{-}PU}$, of the motor axis side may be obtained as follows:

$$K_{P-PU} = \frac{K_P n_{sync} \times 2\pi f_{nm}}{n_{GB}^2 TRQ_{nm}} \tag{28}$$

Moreover, in some embodiments the top drive 42 (e.g., a motor of the top drive 42) accepts the integral time instead of the integral gain. In these embodiments, the integral time, τ (in s), for the speed controller 82 for the top drive 42 may be expressed as follows:

$$\tau=K_P/K_I \tag{29}$$

Therefore, the techniques for mitigating the stick-slip oscillations, in accordance with the present disclosure, using a combination of feedback and feed-forward control schemes. More specifically, the techniques, as described herein, adjust the stiffness and dampening of the top drive 42 in a feed-forward loop through adjusting parameters of the speed controller 82 (e.g., the proportional gain, $K_P$, and the integral gain, $K_I$, as described in Equations (24) and (21), respectively). In certain embodiments, the per unit value of the proportional gain and the integral gain may be calculated according to Equations (28) and (29). In addition, the techniques, as described herein, adjust the speed reference, $\Omega_{ref}$, used by the speed controller 82 using a torque feedback loop (e.g., as described in Equation (10) through adjusting parameters of the feedback controller 80 (e.g., with the filter 84 having the filter function described in Equation (11)). This feedback may allow a higher dampening factor without softening the top drive 42.

Figure 3:
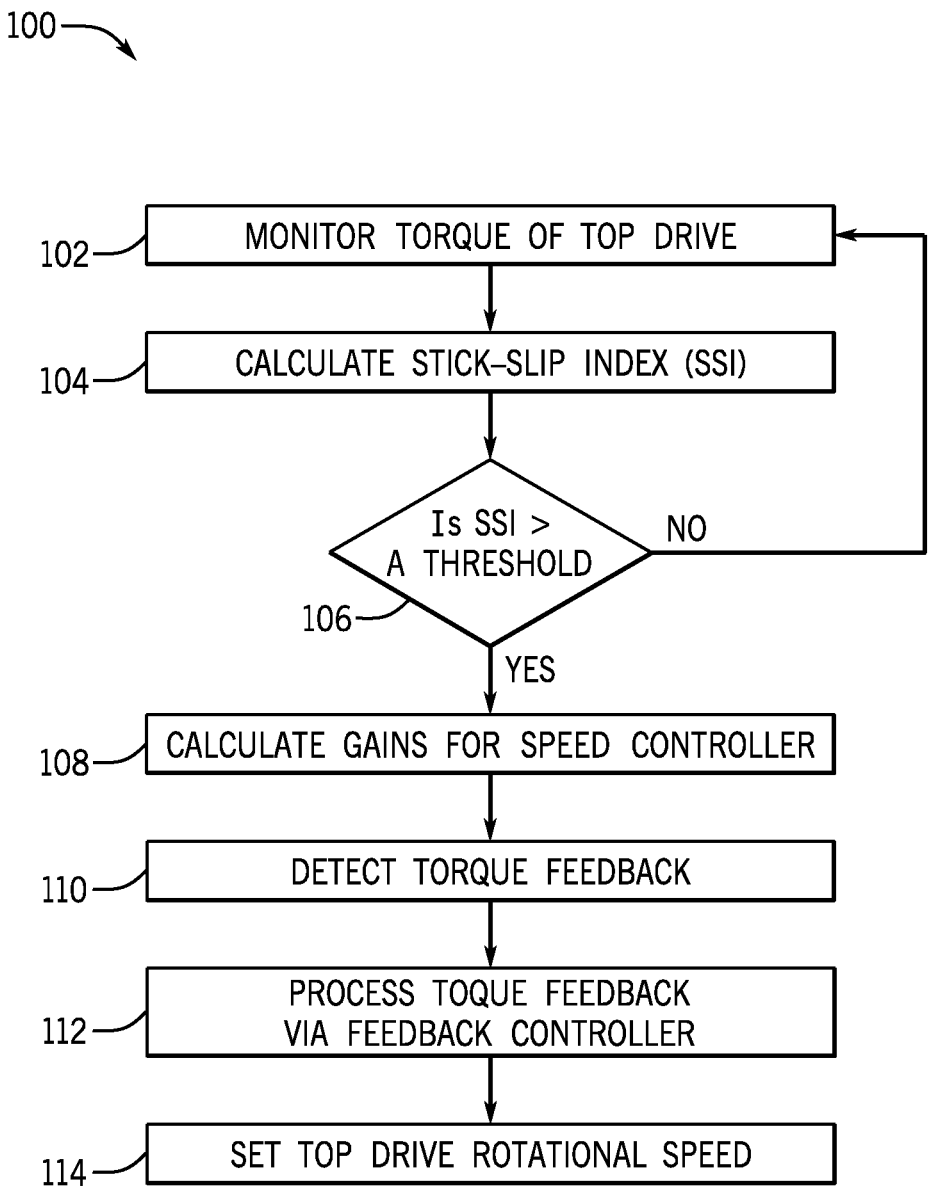
FIG. 3 is a method for mitigating stick-slip in accordance with present techniques.

FIG. 3 illustrates a method 100 for mitigating the stick-slip oscillations of the drilling rig 10 in accordance with the techniques described above. It should be noted that the method 100 may be implemented by the drilling control system 12 either separate from or integrated with existing control schemes for the top drive 42. As noted above, the top drive 42 delivers an output torque (e.g., via the quill 44) to rotate the drill string 30 for drilling the wellbore 32. The torque of the top drive 42 is monitored (block 102) (e.g., via the sensor 70) during drilling (e.g., in real time). The monitored torque profile may include a series of torque values for the top drive 42 at certain time intervals (e.g., 0.001 s, 0.002 s, 0.003 s, 0.004 s, 0.005 s, 0.01 s, 0.02 s, 0.05 s, 0.1 s, 0.2 s, 0.5 s, 1 s, or more). Based on the monitored torque profile of the top drive 42, the control system calculates (block 104) a stick-slip index (SSI). The SSI is defined on the energy of the surface torque signal for describing the severity of the stick-slip oscillation. The SSI may be expressed as follows:

$$SSI = \frac{\sum_{i=1}^{N} (TRQ_i - \langle TRQ \rangle)^2}{(N-1)\langle TRQ \rangle^2} \tag{30}$$

where $TRQ_i$ (i=1, 2, . . . , N) are the monitored torque values of the top drive 42 at different times, i=1, 2, . . . , N, during a time period (or time window), and <TRQ> is the average torque value of all the monitored torque values $TRQ_i$ (i=1, 2, . . . , N) during the time window. The time window may advance with respect to the real time, and the length of time window may be changed by the drilling control system 12 or specified by an operator (e.g., via the user interface 88). As noted above, the stick-slip oscillations occur due to a variation in downhole friction on the drill string 30 (e.g., the drill bit 62), which causes fluctuations of the torque of the drill string 30 and generates the torsional wave that is propagated upwards along the drill string 30 to the top drive 42. As such, the torque of the top drive 42 may include similar oscillations. As indicated by Equation (30), the higher the oscillation of the torque of the top drive 42 around the average value, <TRQ>, the higher SSI may be.

The calculated SSI based on the monitored torque profile of the top drive 42 is then compared (block 106) with a SSI threshold. If the calculated SSI is greater than the SSI threshold, the drilling control system 12 provides a notification (e.g., a warning message, an alarm, a flashing light, or any combination thereof) to an operator, prompting the operator to engage the stick-slip mitigation operations, as will be discussed in greater detail below. In some embodiments, the drilling control system 12 may automatically engage the stick-slip mitigation operations upon detecting that the calculated SSI is greater than SSI threshold. If the calculated SSI is less than or equal to the S SI threshold, the drilling control system 12 continues to monitor the torque of the top drive 42 and to calculate the SSI. The SSI threshold may be set by the control system based on historical data of the drilling rig 10 or empirical values from similar drilling rigs or similar drilling conditions (e.g., rock composition, drilling depth, or the like). In some embodiments, the SSI threshold may be set by the operator (e.g., via the user interface 88).

The drilling control system 12 may engage the stick-slip mitigation operations based on the techniques discussed above. As noted above, the speed controller 82 may include a PI controller. The proportional gain, $K_P$, and the integral gain, $K_I$, for the PI controller may be calculated (block 108) according to the techniques discussed above. As will be discussed in greater detail below, the gains for the speed controller 82 (e.g., the proportional gain, $K_P$, and the integral gain, $K_I$) may be calculated from various parameters related to the operation conditions of the drilling rig 10.

The drilling control system 12 also includes the torque feedback scheme for controlling the speed of the top drive 42. The feedback scheme includes one or more sensor (e.g., the sensor 70) for detecting (block 110) the torque profile of top drive 42. The detected torque profile may be communicated (e.g., via a wireless communication, or a wired communication, or a combination thereof) to the feedback controller 80 of the drilling control system 12. The communication may be in real time (e.g., with the communication delay being less than 25 milliseconds).

The detected torque feedback signal or profile may then be processed (block 112) by the feedback controller 80 (e.g., via the filter 84). As noted above, the filter 84 of the feedback controller 80 may be an AC-decoupling filter with the filter function defined by Equation (11) for filter out low frequency and/or zero frequency components of the torque feedback signal. For example, the torque feedback constant, $k_0$, of the filter 84 may be set to a value such that the cut-off frequency, $\omega_0$, of the filter 84 is at least 10 times below the stick-slip frequency. More particularly, the stick-slip frequency may be between 0.1 Hz and 0.5 Hz, and the cut-off frequency, $\omega_0$, may be between approximately 0.01 Hz and 0.05 Hz, such as approximately 0.01 Hz, 0.015 Hz, 0.02 Hz, 0.025 Hz, 0.03 Hz, 0.035 Hz, 0.04 Hz, 0.045 Hz, or 0.05 Hz.

Other parameters of the filter 84 of the feedback controller 80 may be set based on the torque feedback constant, $k_0$, and the gains of the speed controller 82 (e.g., as indicated in Equations (13) and (14). The processed torque feedback signal from the filter 84 may result in a negligible adjustment in the demanded drilling speed. Accordingly, the rotational speed of the top drive 42 (e.g., rotational speed of the top drive's quill) may be set (block 114) to the reference drilling speed or adjusted negligibly with respect to the reference drilling speed.

Figure 4:
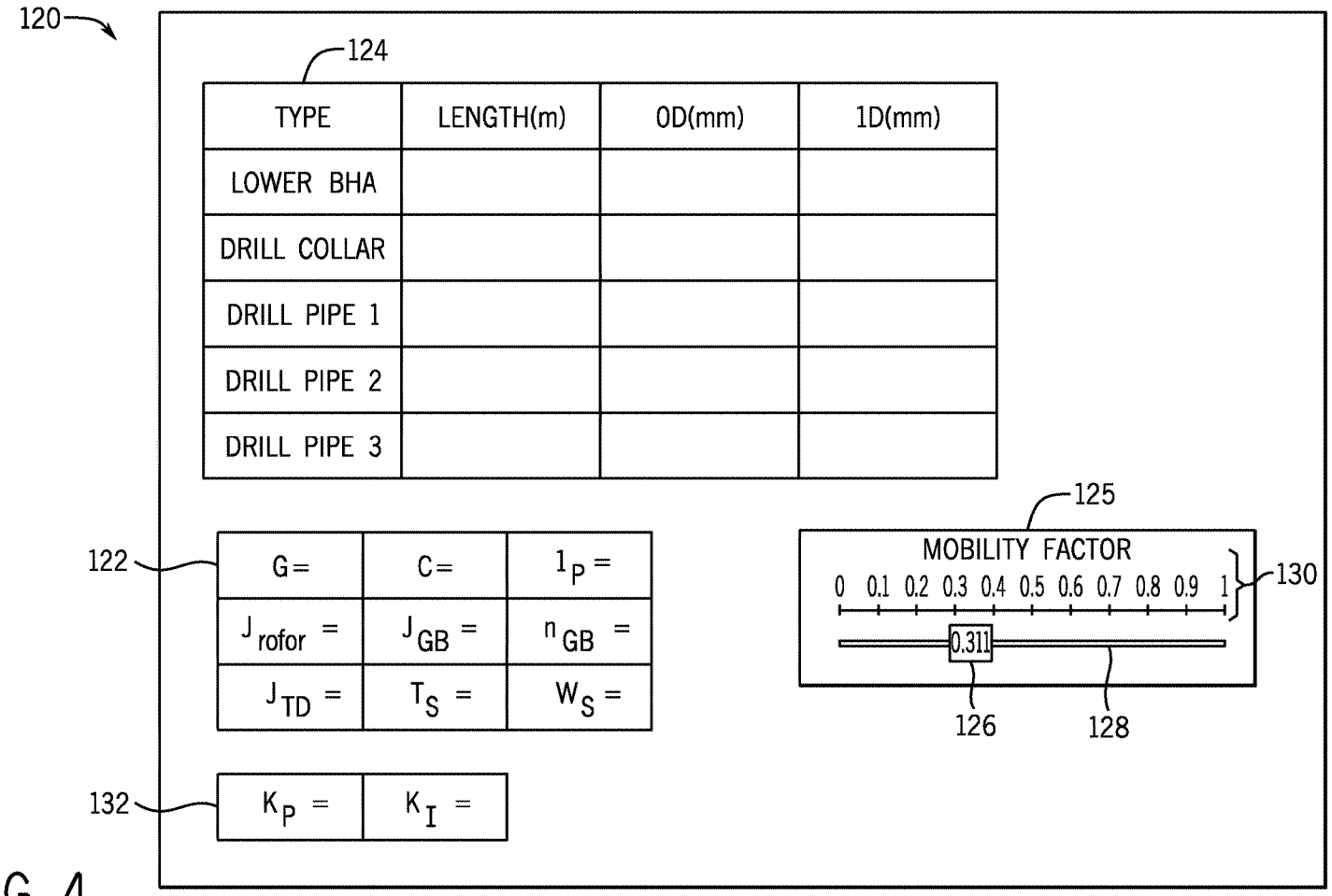
FIG. 4 is a user interface for setting up parameters in a drilling control system in accordance with present techniques.

FIG. 4 illustrates a user interface 120 for setting up parameters in the drilling control system 12 for controlling operations of the top drive 42. More specifically, FIG. 4 illustrates the user interface 120 for displaying, inputting, and/or adjusting parameters related to calculating gains for the speed controller 82. For example, as indicated by Equation (24), the proportional gain, $K_P$, depends at least on (1) the shear modulus of the drill string 30, G, which may be set to a predetermined value (e.g., between $60\times10^9$ $N\cdot m^{-2}$ and $100\times10^9$ $N\cdot m^{-2}$), (2) the speed of the torsional wave, c, which may be set to a predetermined value (e.g., between 2500 $N\cdot m^{-2}$ and 3500 $N\cdot m^{-2}$), (3) the cross-sectional polar moment of inertia of the drill string 30, $I_p$, and (4) the normalized mobility factor, μ. As illustrated in FIG. 4, a box 122 is used for setting up or inputting values of the parameters such as the shear modulus of the drill string 30, G, and the speed of the torsional wave, c.

As shown in Equations (3)-(5), the cross-sectional polar moment of inertia of the drill string 30, $I_p$, may be calculated from dimensions, including the length, the outer diameter, and the inner diameter, of the various tubular 40 (e.g., the drill pipes, the BHA 60) of the drill string 30. The dimensions of the drill string 30 may be obtained before drilling (e.g., from a well plan) or during drilling (e.g., from one or more probes or sensors). The operator may also manually set the values (e.g., via the user interface 88) of the dimensions of the drill string 30. As illustrated, FIG. 4 includes a table 124 for setting up or inputting the dimensions of the drill string 30. The table 124 includes various sections of the drill string 30 (e.g., the lower BHA, drill collar, drill pipe 1, drill pipe 2, and drill pipe 3) and the respective length, outer diameter, and inner diameter of each section. While in the illustrated embodiment, the table 124 includes four sections for the drill string 30, the table 124 may include any number of sections for the drill string 30 and include other dimensional data (e.g., depth) for each section of the drill string 30. The drilling control system 12 may calculate the cross-sectional polar moment of inertia of the drill string 30, $I_p$, from the dimensions of drill string 30 as listed in the table 124 and fill the result into the box 122.

The normalized mobility factor, μ, is related to the stiffness (or softness) of the top drive 42. As discussed above, when the stiffness of the top drive 42 increases, less torsional waves may be dampened by the top drive 42 (or more torsional waves may be reflected, or greater the magnitude of the reflection coefficient, D, may become), and the ROP of the drill string 30 may increase. On the other hand, when the stiffness of the top drive 42 decreases, more torsional waves may be dampened by the top drive 42 (or less torsional waves may be reflected, or smaller the magnitude of the reflection coefficient, D, may become), and the ROP of the drill string 30 may decrease. As shown in Equation (18), (19), and (23), adjusting the normalized mobility factor, μ, may change the magnitude of the reflection coefficient, D, and therefore, the magnitude of dampening of the top drive 42 and the ROP of drill string 30. FIG. 4 also illustrates that the user interface 120 includes an adjuster 125 for adjusting the normalized mobility factor, μ. As illustrated, the adjuster 125 includes a slider 126 for sliding on a bar 128 with marks 130 ranging from 0 to 1. The slider 126 may slide along the bar 130, and the position of the slider 126 with respect to the marks 130 indicates the value of the normalized mobility factor, μ, which may be displayed on the slider 126. In some embodiments, the value of the normalized mobility factor, μ is set or adjusted by the drilling control system 12 automatically. In other embodiments, the adjuster 125 may allow the operator to adjust the value of the normalized mobility factor, μ. It should be noted, however, the adjuster 125 may be any format suitable for setting up the value of the normalized mobility factor, μ, including a box, a dial, a scale, or any combination thereof.

As discussed above, when the normalized mobility factor, μ, is adjusted, the magnitude of dampening and the ROP may be changed accordingly. A lower magnitude of the reflection coefficient, D, implies a softer top driver 42, which implies a higher dampening and a lower ROP. On the other hand, a higher magnitude of the reflection coefficient, D, implies a stiffer top driver 42, which implies a lower dampening and a higher ROP. As such, the normalized mobility factor, μ, may be adjusted such that the drilling rig 10 maintains a balance between the dampening by the top drive 42 and the ROP for the drill string 30. For example, a good range for the magnitude of the reflection coefficient, D, may be between 50% and 90%, such as between 55% and 85%, between 60% and 80%, or between 65% and 75%. In accordance with the present disclosure, the drilling control system 12 may adjust the normalized mobility factor, μ, based on the severity of the stick-slip. For example, when severe stick-slips occur, the normalized mobility factor, μ, may be increased, thereby decreasing the magnitude of the reflection coefficient, D, to have greater dampening. When smooth drilling occurs, the normalized mobility factor, μ, may be decreased, thereby increasing the magnitude of the reflection coefficient, D to have greater ROP.

Therefore, as (1) the shear modulus of the drill string 30, G, (2) the speed of the torsional wave, c, (3) the cross-sectional polar moment of inertia of the drill string 30, $I_p$, and (4) the normalized mobility factor, μ, are determined, the proportional gain, $K_P$, of the speed controller 82 may be calculated (e.g., according to Equation (24)). The value of the proportional gain, $K_P$, may be displayed in a box 132 of the user interface 120 as illustrated in FIG. 4.

As also discussed above, the integral gain, $K_I$, for the PI controller depends at least on (1) the effective mass moment of inertia, $J_{TD}$, of the top drive 42, and (2) the period, $T_s$, of torque oscillation of the top drive 42, according to Equation (21). As noted above, the effective mass moment of inertia, $J_{TD}$, of the top drive 42 may be calculated according to Equation (7). For example, the gearbox inertia, $J_{GB}$, the gear ratio, $n_{GB}$, and the rotor inertia, $J_{rotor}$, of the AC motor of the top drive 42 may be directly obtained from the manufacturer datasheet and be entered (e.g., via the box 122 of the user interface 120) by the operator. The effective mass moment of inertia, $J_{TD}$, of the top drive 42 may then be calculated and filled into the box 122 of the user interface 120. In some embodiments, the drilling control system 12 may calculate the effective mass moment of inertia, $J_{TD}$, of the top drive 42 via a running test of the top drive 42 when the top drive 42 is disconnected from the drill string 30.

The running test for determining the effective mass moment of inertia, $J_{TD}$, of the top drive 42 may include two steps. First, mechanical loss of the top drive 42 due to dry friction and viscous friction may be determined when the top drive 42 is in steady-state and with no load. More specifically, the dry friction torque, $T_d$, and the viscous friction coefficient, B, may be determined for the top drive 42 based on the torque and rotational speed of the top drive 42. The viscous friction coefficient, B, may be expressed as follows:

$$B = \frac{T_2 - T_1}{\omega_2 - \omega_1} \tag{31}$$

where $\omega_1$ and $\omega_2$ (in rad·s$^{-1}$) are two rotational speeds of the top drive 42, and $T_1$ and $T_2$ (in N·m) are the two corresponding torques of the top drive 42. As a specific example, when the top drive 42 is running at a speed of 100 rpm (i.e., 10.472 rad·s$^{-1}$) and has a corresponding torque of 1 N·m, and when the top drive 42 is running at another speed of 1000 rpm (i.e., 104.72 rad·s$^{-1}$) and has a corresponding torque of 1.8 N·m, then the viscous friction coefficient, B, of the top drive 42 is approximately 0.008488 N·m·s·rad$^{-1}$ according to Equation (31). It should be noted that, in this example, the value of the viscous friction coefficient, B, is an illustrative value for a test motor that is smaller (e.g., in size, output power, or the like) than the top drive 42 in the drilling rig 10, which may have a viscous friction coefficient, B, greater than 100 N·m·s·rad$^{-1}$, such as 200 N·m·s·rad$^{-1}$, 300 N·m·s·rad$^{-1}$, 400 N·m·s·rad$^{-1}$, 500 N·m·s·rad$^{-1}$, or more. The dry friction torque, $T_d$, may then be determined based on the following equation:

$$T_d = T_2 - B.\Omega_2 \tag{32}$$

Accordingly, in the above example, the dry friction torque, $T_d$, is approximately 0.9099 N·m from Equation (32).

Figure 5:
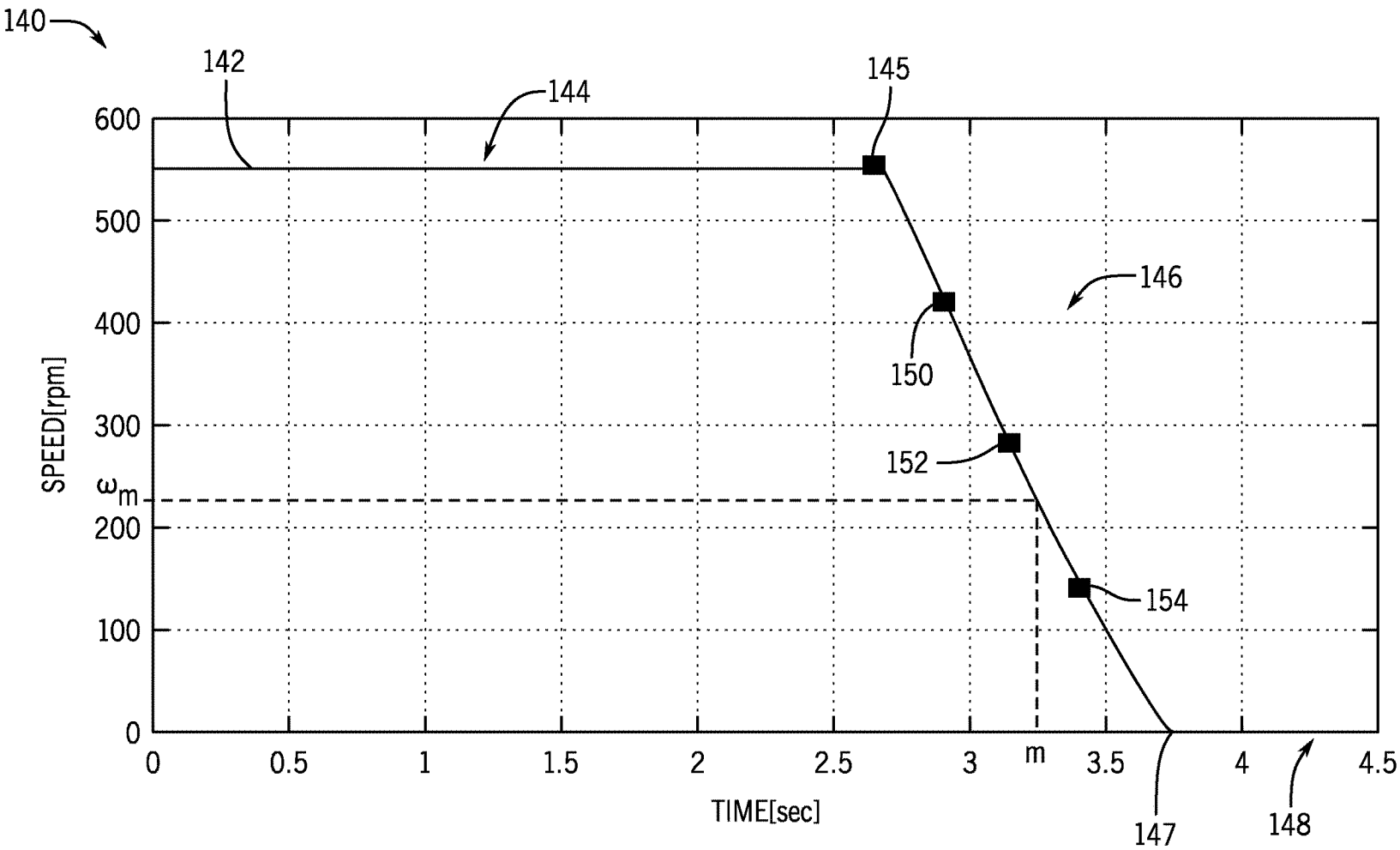
FIG. 5 is a chart of rotational speed as a function of time during a run-out test of a top drive in accordance with present techniques.

The second step of the running test is to determine the effective mass moment of inertia, $J_{TD}$, of the top drive 42 when the top drive 42 is running steady-state at the nominal speed with no load and then running to stop by cutting off the supply voltage. During the period when the supply voltage is cut off, the rotational speed of the top drive 42 decreases from the nominal speed to zero. The second step of the running test may also be referred to as a run-out test. For example, FIG. 5 is a chart 140 illustrating a rotational speed curve 142 as a function of time during a run-out test of the top drive 42. As illustrated, the curve 142 includes a first portion 144 that is substantially flat, denoting that the top drive 42 is running at a constant speed (e.g., at the nominal speed of approximately 550 rpm). When the supply voltage is cut off at a point 145, the rotational speed of the top drive 42 starts to decrease, which is illustrated by a second portion 146 (e.g., a cut-off period). At a point 147, the top drive 42 comes to a full stop, and a third portion 148 represents the top drive 42 at a speed of zero. Based on the chart 140 as well as the dry friction torque, $T_d$, and the viscous friction coefficient, B, obtained from the first step of the running test, the effective mass moment of inertia, $J_{TD}$, of the top drive 42 may be calculated.

More specifically, the effective mass moment of inertia, $J_{TD}$, of the top drive 42 may be expressed as:

$$J = \frac{T_d + B \cdot \omega_m}{-\left.\frac{d\omega}{dt}\right|_m} \tag{33}$$

where $\omega_m$ (in rad·s$^{-1}$) is a rotational speed of the top drive 42 at a time, m, during the cut-off period (e.g., between the point 145 and 147 in FIG. 5), and $$\left.\frac{d\omega}{dt}\right|_m$$

is the slop of the rotational speed curve at the time, m. Because the rotational speed of the top drive 42 and the slope of the rotational speed curve during the cut-off period may be obtained from the run-out test (e.g., the chart 140 of rotational speed versus time in FIG. 5), the effective mass moment of inertia, $J_{TD}$, of the top drive 42 may be calculated based on Equation (33).

For example, in FIG. 5, the cut-off period may be divided into four substantially equal time intervals by three points 150, 152, and 154. The rotational speed at each point 150, 152, 154 may be obtained from the curve 142 directly. The slope of at each point 150, 152, 154 may be represented by a ratio of the speed difference to the time difference between the respective point and the preceding point. For example, the slope at the point 150 may be represented by a ratio of the speed difference to the time difference between the point 150 and the point 145. With the point 145 corresponding to a time of 2.666 s and a rotation speed of 552.6 rpm (i.e., 57.86 rad·s$^{-1}$), and the point 150 corresponding to a time of 2.926 s and a rotational speed of 418.9 rpm (i.e., 43.86 rad·s$^{-1}$), the slope at the point 150 may be represented by (43.86−57.86)/(2.926−2.666)=−53.85 rad·s$^{-2}$. When further using the value of the dry friction torque, $T_d$, and the viscous friction coefficient, B, obtained from the first step of the running test, for example, $T_d$=0.9099 N·m, and B=0.008488 N·m·s·rad$^{-1}$, the effective mass moment of inertia, $J_{TD}$, of the top drive 42 is approximately 0.023 kg·m$^2$ from Equation (33). Similarly, the effective mass moment of inertia, $J_{TD}$, of the top drive 42 may be calculated based on the points 152 and 154, and an average value of the effective mass moment of inertia, $J_{TD}$, of the top drive 42 may be obtained. It should be noted, the effective mass moment of inertia, $J_{TD}$, of the top drive 42 as illustrated above may be calculated based on any point (e.g., the point 150, 152, or 154) during the cut-off period of a run-out test for the top drive 42, or an average value of multiple points. It also should be noted that although FIG. 5 illustrates three points (e.g., the points 150, 152, 154) dividing the cut-off period substantially equally, the same principle may be used for any number of multiple points (e.g., 2, 4, 5, 6, 7, 8, 9, 10, or more) for dividing the cut-off period substantially equally. In the embodiments where the calculated effective mass moment of inertia, $J_{TD}$, of the top drive 42 based on the running test, the value of the calculated effective mass moment of inertia, $J_{TD}$, of the top drive 42 may be entered into the box 122 of the user interface 120 without filling into the box 122 the values of the gearbox inertia, $J_{GB}$, the gear ratio, $n_{GB}$, and the rotor inertia, $J_{rotor}$, of the top drive 42.

Figure 6:
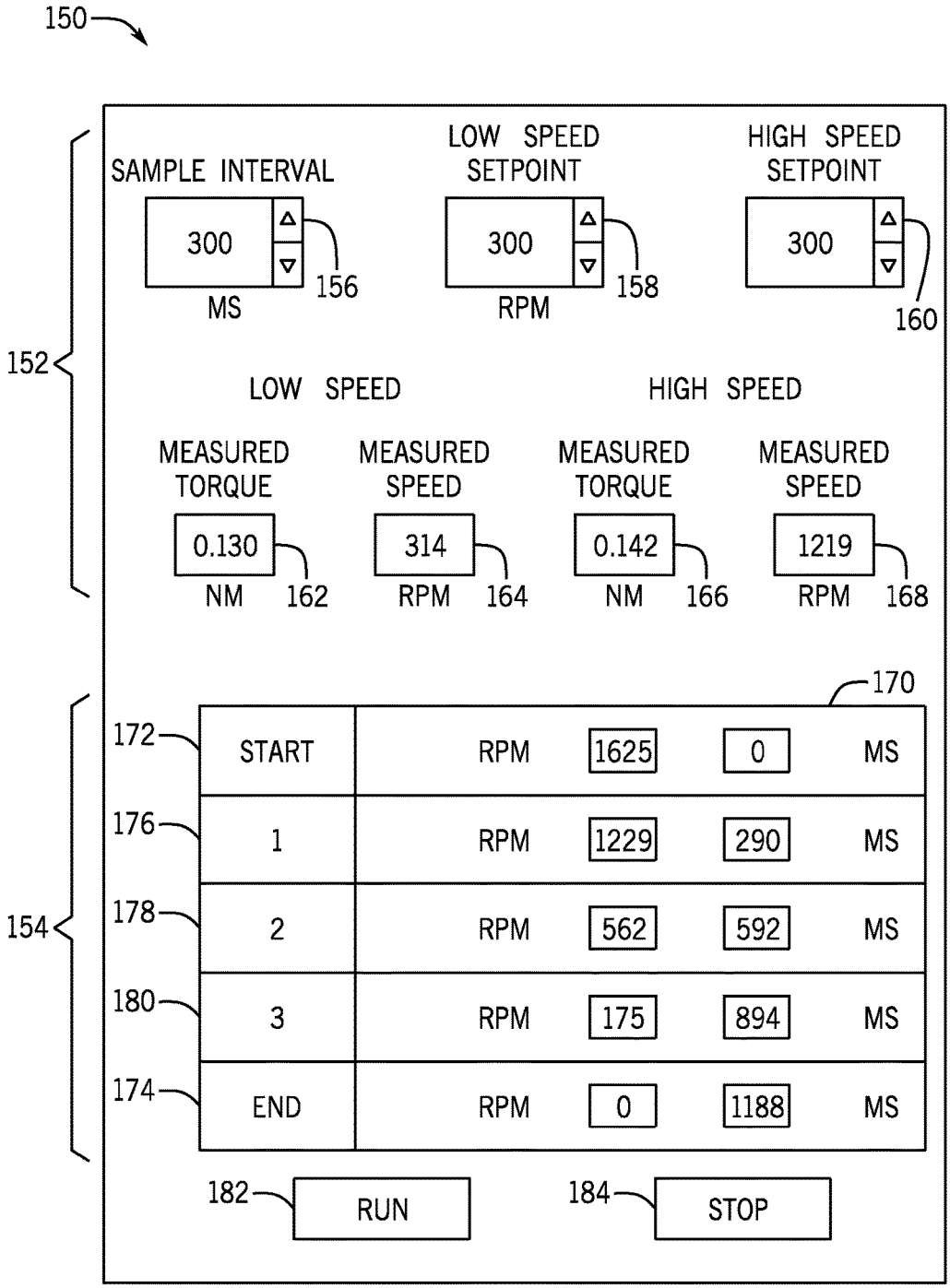
FIG. 6 is a user interface for calculating effective mass moment of inertia of a top drive in accordance with present techniques.

FIG. 6 is a user interface 150 illustrating calculating the effective mass moment of inertia, $J_{TD}$, of the top drive 42 using the running test as described above. The user interface 150 includes two main sections: a first section 152 corresponding to the first step of the running test and a second section 154 corresponding to the second step (e.g., the run-out test) of the running test. The first section 152 includes boxes 156, 158, and 160 for setting up parameters for obtaining two measurements of the rotational speed and the corresponding torque. For example, the box 156 includes a value of sample interval for collecting the rotational speed and the torque data for the top drive 42 when the top drive 42 is running steady-state and with no load. The boxes 158 and 160 include, respectively, a threshold (or setpoint) value of the rotational speed at a low speed and a high speed. As a specific example, the sample interval time may be set at 300 milliseconds (in the box 156), the low speed setpoint at 300 rpm (in the box 158) and the high speed setpoint at 1200 (in the box 160). Accordingly, the controller system 12 collects the speed and torque data every 300 milliseconds and measures the low speed and corresponding torque at or immediately after 300 rpm (e.g., 314 rpm and 0.130 N·m) and the high speed and corresponding torque at or immediately after 1200 rpm (e.g., 1219 rpm and 0.142 N·m). The user interface 150 may display the collected speed and torque data in boxes 162, 164, 166, 168, respectively.

The second section 154 of the user interface 150 includes a box 170 for collecting and displaying various points on the speed-time curve (e.g., the curve 142 as illustrated FIG. 5) during the run-out test. For example, the box 170 includes a first row 170 for collecting and displaying the speed and time of a start point (e.g., the point 145 as illustrated in FIG. 5), when the top drive 42 is running at the nominal speed and with no load, and a last row 174 for collecting and displaying the speed and time of an end point (e.g., the point 147 as illustrated in FIG. 5), when the top drive 42 comes to a full stop after the supply voltage is cut off. The box 170 also includes three intermediate rows 176, 178, 180 for collecting and displaying the speeds and times of three intermediate points (e.g., the points 150, 152, 154 as illustrated in FIG. 5) when the top drive 42 is running during the cut-off period (e.g., the second portion 146 as illustrated in FIG. 5). As noted above, any suitable number (e.g., 1, 2, 3, 4, 5, 6, 7, 8, 9, 10, or more) of intermediate points may be used for the run-out test, and accordingly, the box 170 may include any suitable number (e.g., 1, 2, 3, 4, 5, 6, 7, 8, 9, 10, or more) of intermediate rows. The user interface 150 may also include any other features (e.g., buttons, boxes) for facilitating calculating the effective mass moment of inertia, $J_{TD}$, of the top drive 42. For example, the user interface 150 as illustrated includes a button 182 for starting and another button 184 for stopping the calculation.

Figure 7:
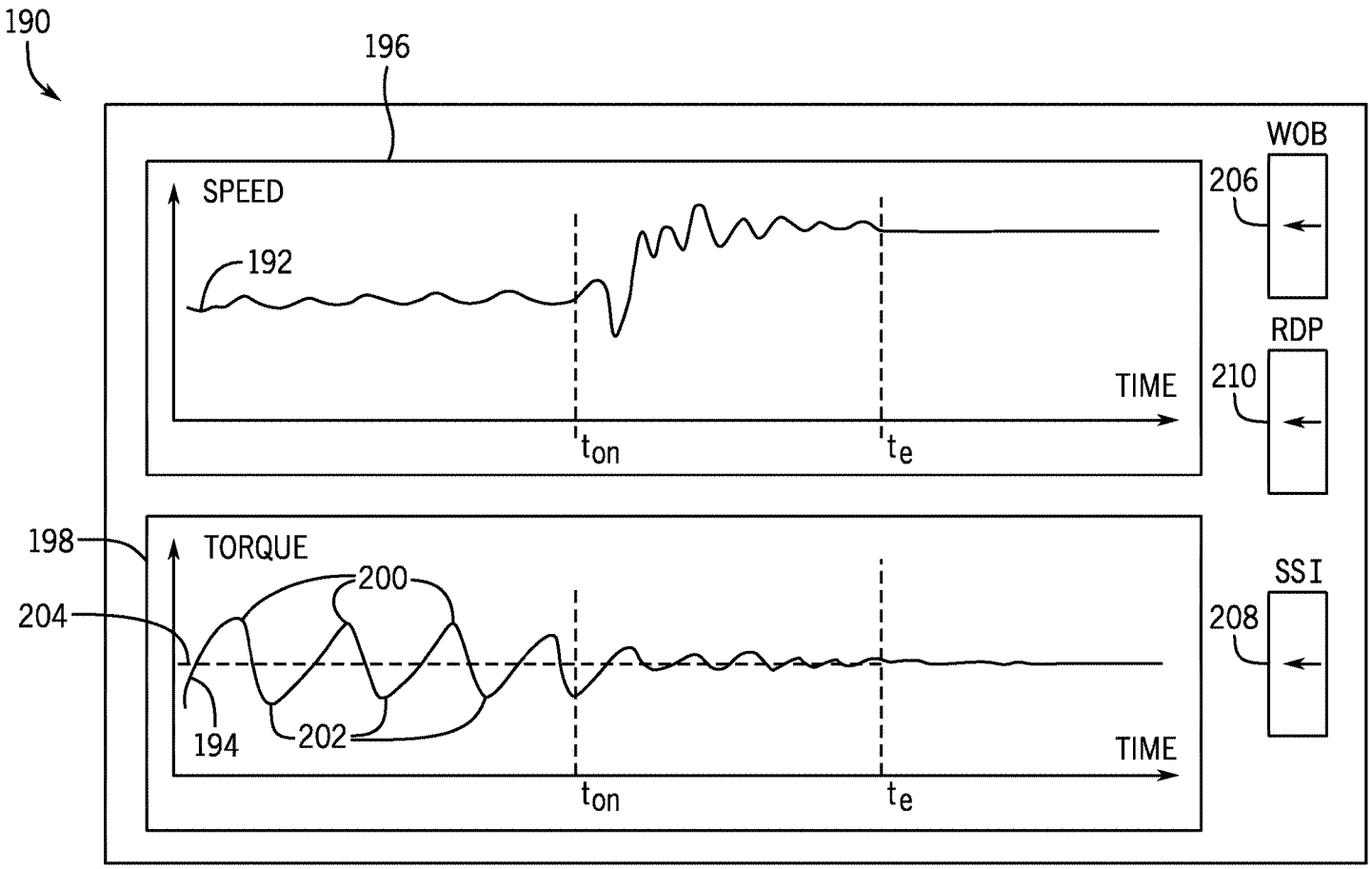
FIG. 7 is user interface for displaying a status of stick-slip in accordance with present techniques.

As noted above, besides the effective mass moment of inertia, $J_{TD}$, of the top drive 42, the integral gain, $K_I$, for the PI controller also depends at least on the period, $T_s$, of torque oscillation of the top drive 42. FIG. 7 illustrates a user interface 190 for displaying a speed profile 192 and a torque profile 194 for the top drive 42. More specifically, a box 196 illustrates the speed of the top drive 42 as a function of time, and a box 198 illustrates the torque of the top drive 42 as a function of time. The speed and torque profiles 192, 194 may be collected in real time (e.g., when the drilling rig 10 is in operation). The speed and torque may be measured by any suitable sensors, including speed sensors, torques sensors, coupled to the top drive 42. The speed and torque profiles 192, 194 may be obtain by collecting individual data points at any suitable time intervals (e.g., 0.001 s, 0.002 s, 0.003 s, 0.004 s, 0.005 s, 0.01 s, 0.02 s, 0.05 s, 0.1 s, 0.2 s, 0.5 s, 1 s, or more).

At a time $t_{on}$, the stick-slip mitigation, according to the techniques discussed in detail above, may be engaged or turned on by the drilling control system 12. As illustrated, before the time $t_{on}$, the torque profile 194 of the top drive 42 may include an oscillation pattern (e.g., the torque oscillation) with a series of alternating peaks 200 and troughs 202. The period, $T_s$, of torque oscillation of the top drive 42 may be obtained from the torque profile 194 in any suitable manner. In one embodiment, the period, $T_s$, of torque oscillation may be measured directly in the torque profile 194 by a distance in time between the adjacent peaks 200 (or troughs 202). Average value of multiple values of the period, $T_s$, may be additionally obtained from multiple pairs of the adjacent peaks 200 (or troughs 202). In another embodiment, the period, $T_s$, of torque oscillation may be obtained by counting a time period between 2n+1 (where n is an integer, such as 1, 2, 3, 4, 5, or more) zero crossings. The zero crossings represent the torque values where the torque profile 194 intersects the mean torque value, as represented by a line 204. In other words, "zero" as used herein is referred to the mean torque value, which may have a magnitude greater than 0. The period, $T_s$, of torque oscillation is thus the counted time period divided by n. In yet another embodiment, the period, $T_s$, of torque oscillation may be obtained by using Fast Fourier Transform (FFT). For example, the torque profile 194 before the time $t_{on}$, may be undergo a FFT to be transferred into data in frequency domain, where the mean frequency is the period, $T_s$, of torque oscillation.

Therefore, as (1) the effective mass moment of inertia, $J_{TD}$, of the top drive 42, and (2) the period, $T_s$, of torque oscillation of the top drive 42, are determined, the integral gain, $K_I$, of the speed controller 82 may be calculated (e.g., according to Equation (21)). The value of the integral gain, $K_I$, may also be displayed in the box 132 of the user interface 120 as illustrated in FIG. 4.

The stick-slip mitigation techniques, as discussed above, have been tested with a downscaled research drilling rig. In a testing set up, the downhole friction applied to the drill string 30 is simulated by rotating the BHA inside a metal (e.g., steel, aluminum, or the like) cylinder. A clutch is used to generate the friction between the BHA and cylinder. The contact force between the BHA and the cylinder is generated by a weight pulling the cylinder back. As such, the contact force may represent the weight on the bit (WOB).

FIG. 7 also illustrates the test results. More specifically, the stick-slip oscillations may be observed on the fluctuations of the surface torque (e.g., the torque profile 194 before the time $t_{on}$). After the stick-slip mitigation is engaged at the time $t_{on}$, the oscillations on the torque profile 194 vanishes gradually. Accordingly, the downhole rotation (e.g., at the BHA) becomes more smooth. For example, at a time $t_e$, the torque of the top drive 42 has substantially a constant value. In some embodiments, by changing the normalized mobility factor, μ, (e.g., via the adjuster 125 as in FIG. 4), the time period between the time $t_{on}$ and the time $t_e$ may be observed to change accordingly. For example, when the normalized mobility factor, μ, is decreased, the time period between the time $t_{on}$ and the time $t_e$ may be longer due to less dampening from the top drive 42.

FIG. 7 also illustrates that the speed profile 192 of the top drive 42 is generally flat before the time $t_{on}$ due to a constant set rotational speed. After the stick-slip mitigation is engaged at the time $t_{on}$, the speed becomes increasingly oscillated due to the adjustment of the rotational speed for the top drive 42 by the controller system 12. The oscillation of the rotational speed also gradually vanishes and becomes substantially a constant value. As illustrated, the user interface 190 also includes other features (e.g., buttons, sliding bars, boxes) for displaying and controlling other parameters. For example, the user interface 190 may include a box 206 for displaying and controlling the WOB, a box 208 for displaying the SSI, and a box 210 for displaying and controlling the ROP. As the parameters, such as the normalized mobility factor, μ, is changed, the WOB, the SSI, and the ROP may change accordingly for monitoring and displaying the performance of the BHA.

Present embodiments are believed to be capable of addressing issues related to stick-slip. The stick-slip mitigation system according to the present embodiments utilizes is a combination of torque feedback and feed-forward impedance matching. The present embodiments allows a tradeoff between the optimum dampening ratio on reflected torsional wave by the top drive 42 and rate of penetration (ROP) of the drill string 30. The present embodiments also include user interfaces for automatically monitoring, calculating, displaying, parameters for the stick-slip mitigation system.

While only certain features of the present disclosure have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A system for rotating a drill string, comprising:

a drive system configured to rotate the drill string at variable rotational speeds based on control signals received by the drive system; and a control system configured to transmit the control signals to the drive system, wherein the control system is configured to generate the control signals based on at least a frequency of stick-slip oscillations at the drive system, a characteristic impedance of the drill string, and torque values of the drive system, wherein the control system comprises a feedback controller and a PI controller, wherein the feedback controller is configured to receive the torque values of the drive system, and the PI controller is configured to update a proportional gain and an integral gain based on at least the torque values of the drive system.

2. The system of claim 1, wherein the drive system comprises a top drive configured to rotate the drill string based on the control signals.

3. The system of claim 1, comprising a torque sensor coupled to the drive system and configured to measure the torque values of the drive system.

4. The system of claim 1, wherein the control system is configured to determine the frequency of stick-slip oscillations at the drive system based on output torque values of the drive system.

5. The system of claim 1, wherein the control system is configured to determine a shear modulus of the drill string, a cross-sectional polar moment of inertia of the drill string, and a speed of torsional waves along the drill string for generating the control signals based on the characteristic impedance of the drill string.

6. The system of claim 1, wherein the proportional gain is based on at least a shear modulus of the drill string, a cross-sectional polar moment of inertia of the drill string, and a speed of the torsional waves propagating along the drill string.

7. The system of claim 1, wherein the integral gain is based on at least the frequency of stick-slip oscillations at the drive system and an effective mass moment of inertia of the drive system.

8. The system of claim 1, wherein the feedback controller comprises a filter having a cut-off frequency lower than the frequency of stick-slip oscillations, wherein the filter is configured to receive the torque values of the drive system and to provide filtered torque values , and the control signals are based on the filtered torque values.

9. The system of claim 1, wherein the filter comprises a torque feedback constant depending at least on the cut-off frequency of the filter and the integral gain of the PI controller.

10. The system of claim 9, wherein the filter comprises an adjustment coefficient depending at least on the torque feedback constant of the filter and the proportional gain of the PI controller.

11. A control system, comprising:

an automation controller including a processor and a memory configured to supply a drive system for rotating a drill string with control signals based on at least a frequency of stick-slip oscillations at the drive system, a characteristic impedance of the drill string, and torque values of the drive system, wherein the automation controller comprises a feedback controller and a PI controller, wherein the feedback controller is configured to receive the torque values of the drive system, and the PI controller is configured to update a proportional gain and an integral gain based on at least the torque values of the drive system; and a display visualization configured to display at least the frequency of stick-slip oscillations at the drive system, the characteristic impedance of the drill string, and the torque values of the drive system.

12. The control system of claim 11, wherein the feedback controller comprises a filter having a cut-off frequency lower than the frequency of stick-slip oscillations, wherein the filter is configured to receive the torque values of the drive system and to provide filtered torque values, and the control signals are based on the filtered torque values.

13. The control system of claim 12, wherein the filter comprises a torque feedback constant depending at least on the cut-off frequency of the filter and the integral gain of the PI controller, and an adjustment coefficient depending at least on the torque feedback constant of the filter and the proportional gain of the PI controller.

* * * * *